United States Patent [19]

Cavanaugh

[11] 4,327,571

[45] May 4, 1982

[54] DIE STRIPPING APPARATUS

[76] Inventor: Walter B. Cavanaugh, 221 Hillview, Hurst, Tex. 76053

[21] Appl. No.: 176,034

[22] Filed: Aug. 7, 1980

[51] Int. Cl.[3] ..... B21D 22/00

[52] U.S. Cl. ..... 72/344; 72/427

[58] Field of Search ..... 72/344, 345, 427

[56] References Cited

U.S. PATENT DOCUMENTS

| | | | |
|---|---|---|---|
| 2,348,064 | 5/1944 | Gebhardt | 72/344 X |
| 2,369,260 | 2/1945 | Slater | 72/344 |
| 3,203,218 | 8/1965 | Bolt et al. | 72/344 X |
| 4,121,447 | 10/1978 | Sniady | 72/344 |

*Primary Examiner*—Leon Gilden

[57] ABSTRACT

A new and improved die stripping apparatus is provided for use in a body forming apparatus wherein a punch forces a metal blank through a die by means of a ram. This apparatus includes a platform located in a plane perpendicular to the punch and ram, and the platform has a die opening formed therein. Means are provided for forming a plurality of channels in the platform wherein each of the channels has a longitudinal axis parallel with the plane of the platform and located on a radii of the die opening. A corresponding plurality of segments are slidably mounted in the channels and biased inwards towards the die opening.

8 Claims, 7 Drawing Figures

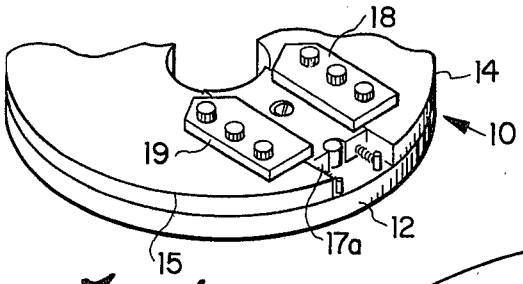
Fig 1
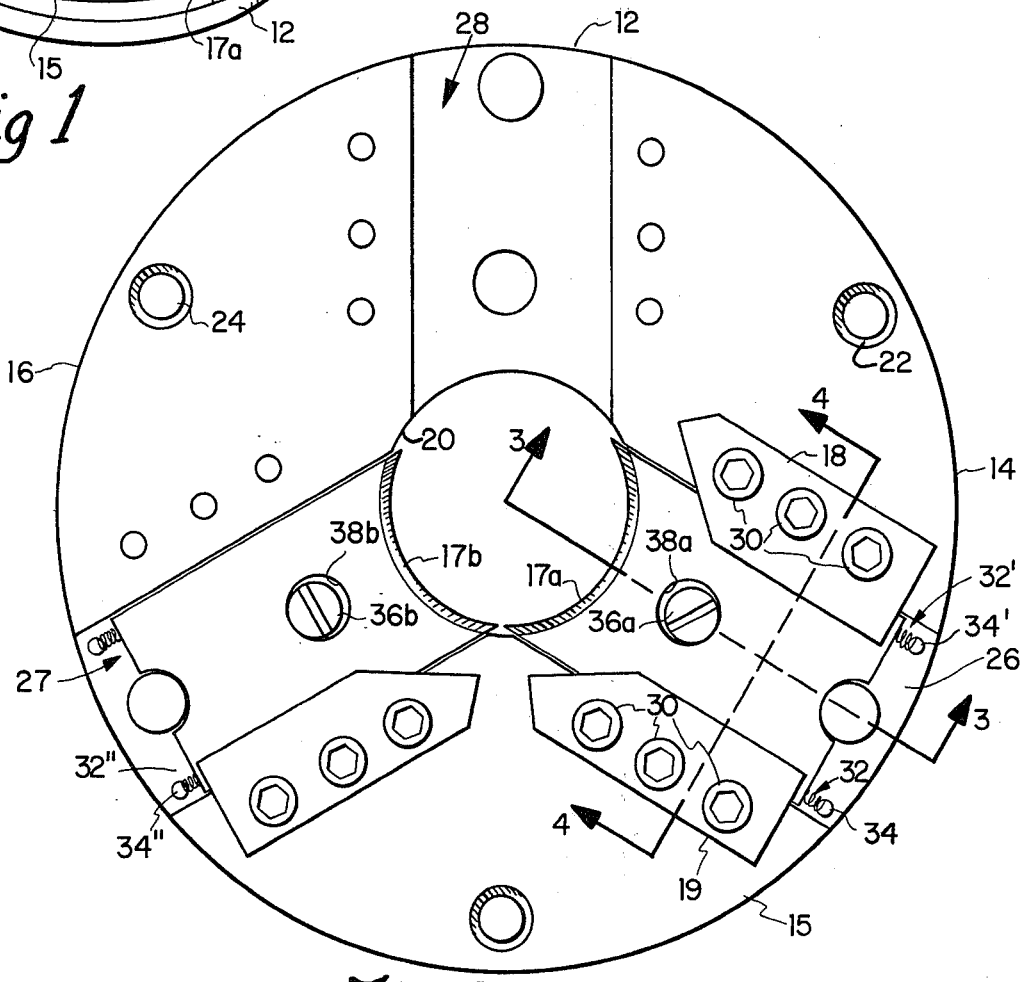
Fig 2
Fig 3a
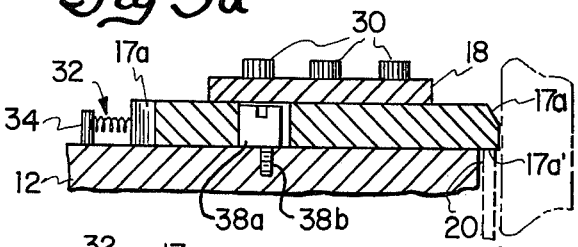
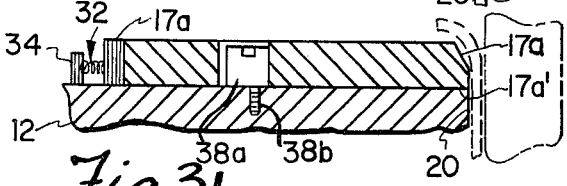
Fig 3b
Fig 4a
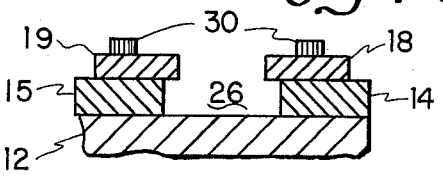
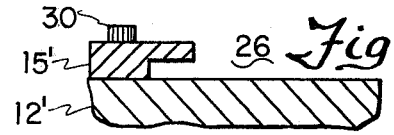
Fig 4b
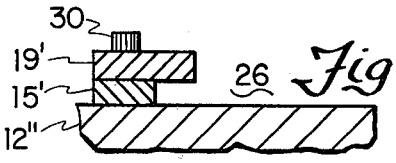
Fig 4c

DIE STRIPPING APPARATUS

BACKGROUND OF THE INVENTION

1. Field of the Invention

This invention relates to an apparatus useful in the formation of sheet material, and more particularly, to an improved die stripping apparatus for use in a can body forming apparatus.

2. Prior Art

It has long been known in the metal forming art that objects may be formed from a metal blank by forcing the blank through a series of ironing dies under the force of a ram. Such a process is used to form the well known one-piece aluminum can body.

Once the can is formed, it is tightly engaged on a punch attached to the end of the ram and must be removed as the ram retracts through the ironing dies.

Strippers are commonly used to remove the formed can from the punch, which strippers usually comprise a plurality of segments that are arranged concentrically about the punch. Typically, the segments are biased against the punch in such a manner so as to move out of the way when the punch is moving downward to form the can, and grip the upper rim of the can when the punch retracts. Such a prior art can stripping apparatus is disclosed in U.S. Pat. No. 4,095,452, which issued to Fred Cruz on June 20, 1978. Other types of can-stripping equipment have been employed in the past, one such can stripper is disclosed in U.S. Pat. No. 3,390,565 of A. Dean Smith, et al. As disclosed, multiple segments of suitable material (e.g. twenty segments of hardened tool steel) are mounted concentrically around a can forming punch. On the final forming action of the punch the can and the punch combination are driven through the stripper section, causing the segments to deflect out of the path of the can and punch. With the passage of the can past the can stripper, the segments return to a position of close proximity to the punch. With the withdrawal of the punch, the segments engage the can opening toward the rear of the punch and hold the can while the punch is further withdrawn, freeing the can from the punch. All of the prior art can strippers work in essentially the same way.

A disadvantage of the prior art can strippers is that due to the combined need for concentricity of the segments with the can punch, and for a depressing movement of the segments, which normally requires some rotation parallel to the longitudinal axis of the punch, the segments must be numerous and relatively small and narrow. This greatly increases the difficulty in adjusting the segments to assure proper engagement with the can without engaging and thereby damaging the punch.

A further disadvantage of the prior art is that the can strippers are relatively complex and expensive.

Another disadvantage of the prior art is that the segments, being small and with little bearing surface, wear rapidly and need relatively frequent replacement.

SUMMARY OF THE INVENTION

An improved die stripping apparatus is provided, which is of the type used in a can body forming apparatus wherein a punch forces a metal blank through a die by means of a ram.

The improvement comprises a platform located in a plane perpendicular to the punch, and the platform includes a die opening therein. Means are provided for forming a plurality of channels in the platform wherein each of the channels has a longitudinal axis parallel with the plane of the platform and located on a radii of the die opening. A corresponding plurality of segments are slidably mounted in the channels and biased inward towards the die opening. This arrangement allows the segments to move outward from the die opening when the punch forces a metal blank through the die opening for forming the can body, and the biasing forces the segments inward for securing the can body on the upward movement of the punch so as to strip the can body from the punch.

A plurality of laterally engaging can stripper segments capture and hold a can against a retraction movement of a punch for the purpose of stripping the can form the punch. The multiplicity of laterally engaging segments can be substantially less than was true of can strippers in the prior art. In one embodiment, three strippers are used as opposed to twenty strippers, because the need for a depressing or rotating movement has been eliminated. The laterally engaging segments are appropriately shaped to allow free movement at right angles, or laterally, to the direction of travel of the can punch with adjustable eccentric stops to prevent engagement with the punch. The laterally engaging segments are biased toward a point of closest proximity to the punch by springs so as to cause the can stripper to return to a position of engagement with the can on the withdrawal stroke of the punch, yet to be easily pushed aside by the final forming stroke of the punch. To facilitate this action, the laterally engaging segments have a slight bevel or contour on the side first engaged by the can on a forming stroke and a lip with little or no bevel or contour on the side first engaged by the can on the stripping side. It may be appreciated that any shape allowing slippage past the segments in one direction with engagement in the other would suffice.

BRIEF DESCRIPTION OF THE DRAWINGS

FIG. 1 is a cut-away perspective view of the can stripping apparatus of this invention;

FIG. 2 is a planar view of the apparatus of this invention;

FIG. 3 is a cross-sectional view of a slidable segment taken along the section line 3—3 of FIG. 2; and, FIGS. 4*a* through 4*c* are alternate embodiments of the guides and retainers for the slidable segment.

DETAILED DESCRIPTION:

Referring now to the drawings, and to FIG. 1 in particular, the can stripping apparatus 10 of this invention is shown in a cut-away perspective view. In accordance with one embodiment, a base plate 12 supports three pie-shaped guides 14, 15 and 16, of which only portions of guides 14 and 15 are shown in FIG. 1. A slidable segment 17*a* is disposed between the guides 14 and 15 for sliding radially with respect to the circular base plate 12. Retainers 18 and 19 are affixed to the guides 14 and 15, respectively, to retain the segment 17*a* in the channel formed between the guides 14 and 15 and the base plate 12.

A more detailed view of the segment 17*a*, guides 14, 15 and 16, and the retainers 18 and 19 may be had by referring to FIG. 2 wherein there is shown a die opening 20 in the base plate 12 for receiving the can body forming punch (not shown).

In accordance with this embodiment, the three pie-shaped guides 14, 15 and 16 are secured to the base plate 12 by means of fasteners 22, 23 and 24, respectively. This arrangement forms three channels 26, 27 and 28 between the guides and on the base plate 12 for receiving slidable segments 17*a* and 17*b* (of which only segments 17*a* and 17*b* are shown in FIG. 2).

The retainers 18 and 19 are secured to the guides 14 and 15, respectively, by means of fasterners 30 so as to retain the segments parallel with the plane of the base plate 12 during operation of the apparatus, which will be described further hereinafter. The segments, such as segment 17*a*, are biased towards the die opening 20 by means of springs 32, 32', 32" located between the segments and studs 34, 34', 34" secured to the base plate 12. The distance of travel of the segments 17*a* and 17*b* is governed by eccentric screws 36*a* and 36*b*, respectively, which eccentric screws are located in openings 38*a* and 38*b* of the same segments and are secured in the base plate 12.

At this juncture of the description it may be appreciated that the eccentric screws provide a means for adjusting the distance of travel of the segments, which allows for ready adjustment of any wear of the individual components of this apparatus during its useful life of operation.

The arrangement of the segments with respect to the channels, springs and the eccentric screws may be more clearly seen by reference to FIGS. 3*a* and 3*b*, which are sectional views taken along the line 3—3 of FIG. 2. As may be seen in the cross-sectional view of FIG. 3*a*, the spring 32 is expanded since the segment 17*a* is located at its inner-most position, or in a relaxed state. Also, note, that the eccentric 36*a* resists any additional inward movement of the segment 17*a*. The position of the segment 17*a* as shown in FIG. 3*a* occurs when the punch and the formed can body (both of which are not shown) are removed from the die, or when the die is being removed after forming the can body. In the latter occurrence, it should be appreciated that as the die is being removed the bottom lip 17*a*' grasps the top edge of the formed can body so as to strip the can from the die. The dimensions of the various parts shown in FIG. 3*a* are exaggerated for clarity purposes only.

As the punch is forcing the metal blank down through the die, the segments 17 slide outward to a position as shown in FIG. 3*b*. Note that the edge of the segment 17*a* now aligns with the plate 20, and that the bias spring 32 is collapsed.

The segments 17 may be retained in the channels 26, 27 and 28 by various alternate means as illustrated in greater detail in FIGS. 4*a* through 4*c*, which are taken along section line 4—4 of FIG. 2. The embodiment in FIG. 4*a* is substantially the same as that illustrated and described hereinabove. That is, retainers 18 and 19 are secured to the pie-shaped guides 14 and 15 respectively. FIG. 4*b* illustrates a securing means created by forming channel guides along edges of the guides such as guide 15. This, of course, requires additional machining of the guides. Yet another securing means may be created by employing rectangularshaped guides 15" in lieu of the pie-shaped guides 14, 15 and 16 as shown in FIG. 4*c*. This embodiment may not be preferred since additional strength is imparted to the base plate 20 by means of these pie-shaped guides, whereas the rectangular-shaped guides 15" may not impact such strength. Alternatively, a combination of the guide embodiments shown in FIGS. 4*b* and 4*c* may likewise be employed.

While there have been described at present are believed to be the preferred embodiments of this invention, it will be obvious to those skilled in the art that various changes and modifications may be made therein without departing from the invention, and it is aimed, therefore, to cover in the appended claims all such changes and modifications as fall within the true spirit and scope of the invention.

I claim:

1. An improved die stripping apparatus of the type used in a can body forming apparatus wherein a punch forces a metal blank through a die by means of a ram, the improvement comprising: a platform located in a plane perpendicular to the punch, said platform having a die opening therein: means forming a plurality of channels in said platform, each of said channels having a longitudinal axis parallel with the plane of said platform and located on radii of said die opening; a corresponding plurality of segments slidably mounted in said channels; means for biasing said segments inward toward said die opening whereby said segments move outward from said die opening when the punch forces a metal blank through said die opening for forming the can body, and said segments secure the formed can body on the upward movement of said punch so as to strip the can body from the punch; and eccentric screw means secured to said platform and disposed in openings formed in each of said segments for limiting the movement of said segments, thereby providing an adjustment of said apparatus.

2. An improved die stripping apparatus as in claim 1 further characterized by said segments having beveled edges for facilitating movement of said segments during a downward stroke of said ram.

3. An improved die stripping apparatus as in claim 1 further characterized by said means forming a plurality of channels including pie-shaped guides secured to said platform.

4. An improved die stripping apparatus as in claim 3 further characterized by retainers secured to said pie-shaped guides for retaining said segments in the channels.

5. An improved die stripping apparatus as in claim 3 further characterized by said pie-shaped guides having channelled edges so as to form retainers for said segments in the channels.

6. An improved die stripping apparatus as in claim 1 further characterized by retainers secured to said rectangular-shaped members for retaining said segments in the channels.

7. An improved die stripping apparatus as in claim 1 further characterized by means for stopping said segments in a position so as to engage the can body during a withdrawal movement of said ram and without engaging said ram.

8. An improved die stripping apparatus as in claim 7 further characterized by said means for stopping comprising said eccentric screw means.

* * * * *